US005546885A

United States Patent [19]

Porada

[11] Patent Number: 5,546,885

[45] Date of Patent: Aug. 20, 1996

[54] COLLAPSIBLE SCUBA TANK SUPPORTS FOR AN INFLATABLE DINGHY

[76] Inventor: William M. Porada, 2785 Pacific Coast Hwy., #E-244, Torrance, Calif. 90505

[21] Appl. No.: 542,076

[22] Filed: Oct. 12, 1995

[51] Int. Cl.[6] ..... B63B 7/00

[52] U.S. Cl. ..... 114/345; 224/406; 114/85; 114/315

[58] Field of Search ..... 114/343, 345, 114/85, 315; 441/40; 224/42.42, 42.33, 42.32

[56] References Cited

U.S. PATENT DOCUMENTS 4,807,555 2/1989 Hart ..... 114/345
5,299,721 4/1994 Cummings ..... 114/345

FOREIGN PATENT DOCUMENTS 1199652 8/1965 Germany ..... 114/345

*Primary Examiner*—Edwin L. Swinehart
*Attorney, Agent, or Firm*—Herbert M. Shapiro

[57] ABSTRACT

Inflatable rubber dinghies, familiar around most wharf areas, are made safe for scuba tank users by a plurality of interlocking rigid base sections which insert laterally across the floor of the dinghy and over both inflatable side tubes of the dinghy. Each base section includes a support for holding a scuba tank in an upright position and each such support is secured to a rail, running front-to-back along the axis of the dinghy, to which the base sections are secured. The interlocking inserts not only provide for secure transport of the scuba tanks but do so in a way which occupies little space and provides for increased stability for the dinghy.

6 Claims, 2 Drawing Sheets

COLLAPSIBLE SCUBA TANK SUPPORTS FOR AN INFLATABLE DINGHY

FIELD OF THE INVENTION

This invention relates to inflatable dinghies and removable supports for scuba tanks in such dinghies.

BACKGROUND OF THE INVENTION

Inflatable dinghies are familiar around most wharf areas. They comprise inflatable tubes which assume the shape of a boat, when inflated, and contain a flexible rubber floor, suspended by the inflatable tubes, to support passengers. Often, such a dinghy includes a rear transom for supporting a motor. Although such dinghies are fun to use and often are used in emergencies or for local passenger commuting, they are not sufficiently stable to support several passengers with scuba gear.

BRIEF DESCRIPTION OF THE INVENTION

The present invention is directed at removable supports for scuba tanks which not only provide for safe transport of the tanks but also for significant improvement in overall stability of the dinghy. In accordance with the principles of this invention, a plurality of lateral base sections are attached to rails which lie on the rubber floor of the dinghy and extend over the inflatable side portions of the dinghy. The base sections are connected into a single unit by attachment to rails which extend, front-to-back along the rubber floor. The base sections are of light, rigid material such as fiberglass.

Each base section includes a support for a scuba tank. The support, in each instance extends through a hole in a base section and is secured to a rail. Each scuba tank support holds a scuba tank in an upright position and thus not only secures the scuba tank but does so in a manner to occupy relatively little space.

DETAILED DESCRIPTION OF AN ILLUSTRATIVE EMBODIMENT OF THIS INVENTION

Figure 1:
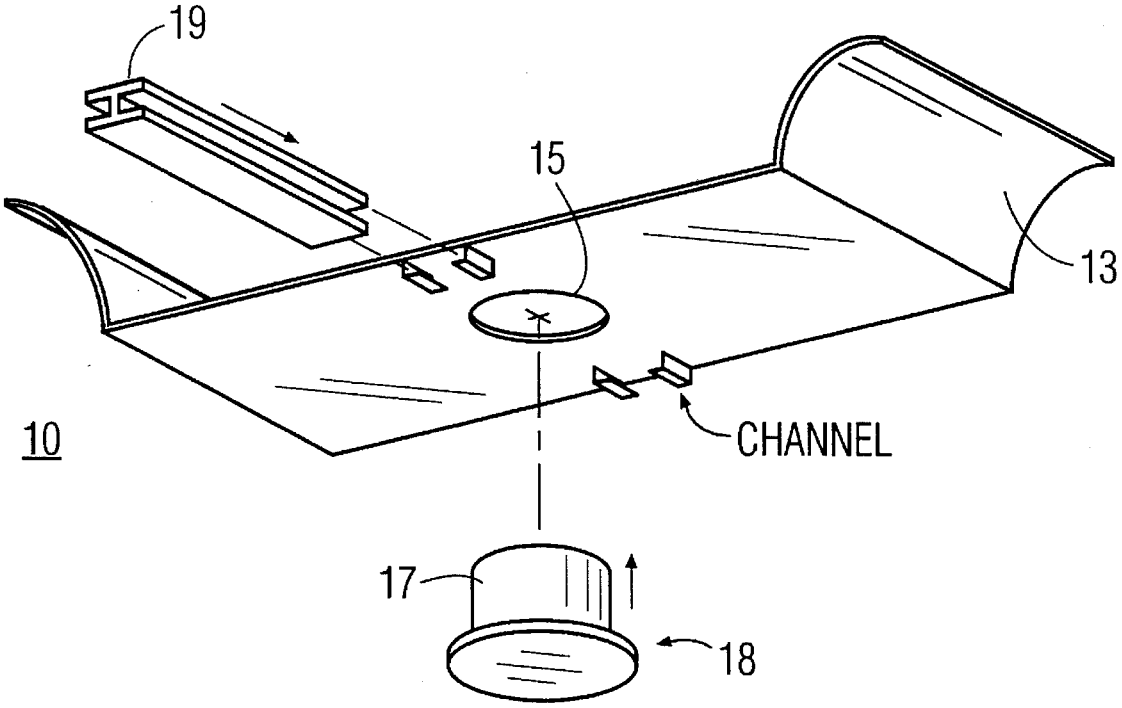
FIG. 1 is an exploded view of a base section and tank support in accordance with the principles of this invention.

FIG. 1 shows a base section 10 in accordance with the principles of this invention. The base section comprises, for example, a fiber glass panel which is rigid and has a flat section 11 with curved sections 13 and 14 which are shaped to conform to the inflated side tubes of a dinghy when inflated. The flat section 11 includes a hole 15 through which tube 17 extends. Tube 17 has a bottom plate 18 which connects to a rail, or I-beam, 19 to which flat section 11 also is mounted. The dimensions of the floor section 11 and curved sections 13 and 14 are dictated by the size of a rubber dinghy and the base section is made to conform to the shape of a dinghy.

Figure 2:
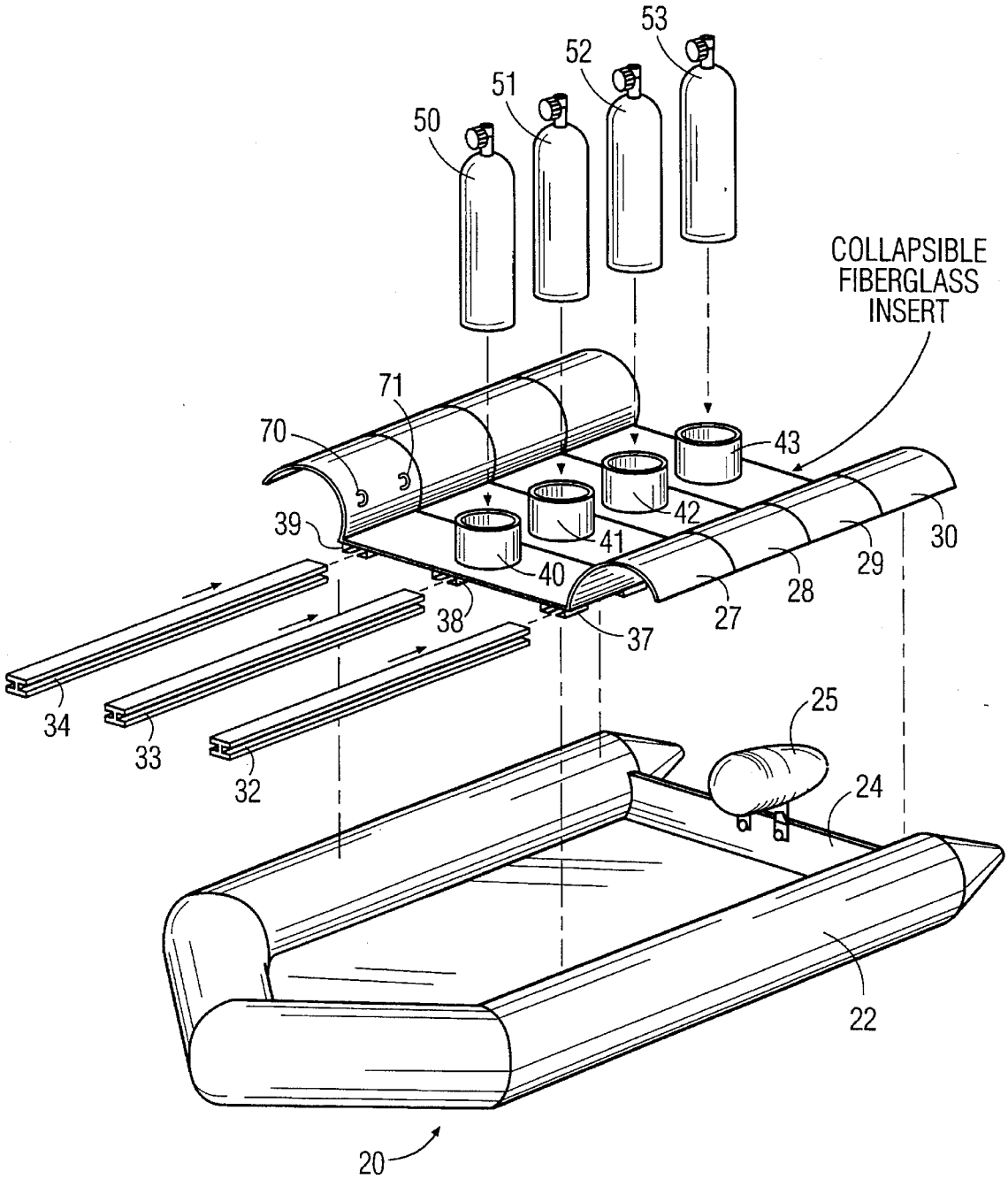
FIG. 2 is an exploded view of a plurality of base sections of FIG. 1 along with a representative rubber dinghy and a plurality of scuba tanks in accordance with the principles of this invention.

FIG. 2 shows an exploded view of an illustrative rubber dinghy 20 which has a floor 21 with inflatable side tubes 22 and 23 and a rear transom 24 on which motor 25 is mounted. A plurality of base sections, illustratively four, are shown in FIG. 2. The base sections, designated 27, 28, 29 and 30 in FIG. 2, are mounted on three I-beams 32, 33 and 34 by brackets 37, 38 and 39 respectively.

The I-beams are positioned such that I-beam 33 is along the center line of the dinghy and I-beams 32 and 34 fit snugly against side, inflated tubes 22 and 23 respectively.

Each base section includes at least one hole through which a tube is inserted as shown in FIG. 1. FIG. 2 shows four such tubes in place. The tubes are designated 40, 41, 42 and 43 for base sections 27, 28, 29 and 30 respectively. The base plates, not shown in FIG. 2, are mounted on I-beam 33 as was discussed in connection with FIG. 2. Each tube has a diameter and a vertical dimension to accept a scuba tank and secure the tank in an upright position. FIG. 2 shows four such tanks, 50, 51, 52 and 53 positioned for insertion into tubes 40, 41, 42 and 43 respectively.

The tubes are mounted on center I-beam 33 in order to position the scuba tanks along the center line of the dinghy. Such a position not only adds to the stability of the dinghy but also allows for maximum seating capacity along side tubes 22 and 23. The I-beams may be any such rails which are operative to connect the inserts, or base sections, together.

Each base section conveniently includes a pair of holes, or rings, for mating with the ends of a ladder. FIG. 2 shows such rings 70 and 71 in base section 27. Typically, such a ladder extends over the inflated side tube down into the water and is used by a scuba diver for entering the dinghy from the water or vice versa.

The invention has been described in terms of a base section including one support for a scuba tank. It should be clear that more than one support may be provided in each base section. Further, the invention is particularly useful for inflatable dinghies with rubber floors. It is contemplated that dighies with other than rubber floors could similarly benefit by the provision of base sections organized as described herein in accordance with the principles of this invention.

What is claimed is:

1. A collapsible insert for an inflatable rubber dinghy having a floor and inflated side tubes for supporting said floor, said insert comprising a plurality of base sections, each of said base sections including a flat section with end sections curved upwards and outwards to conform to said inflated side tubes with said flat section extending therebetween, said inserts being arranged front-to-back on said floor and mounted on a plurality of rails.

2. A collapsible insert for an inflatable rubber dinghy having a floor and inflatable side tubes for supporting said floor, said insert comprising a plurality of base sections, each of said base sections including a flat section with end sections curved to conform to said inflated side tubes with said flat section extending therebetween, said inserts being arranged front-to-back on said floor and mounted on a plurality of rails wherein each of said base sections includes at least one hole and a tube extending upright in said hole, said tube having a diameter and a vertical dimension to accept a scuba tank and to secure such a tank in an upright position.

3. A collapsible insert as in claim 2 wherein said plurality of rails includes a center rail and first and second side rails, wherein said holes in said base sections are positioned to correspond to said center rail and are supported by said center rail.

4. An insert for an inflatable dinghy for the transport of a scuba tank therein, said insert comprising a base section extending laterally across the floor of said dinghy and over the inflated side tubes thereof, said base section including a hole therein and a tubular support extending through said hole and having a diameter and a vertical dimension to secure a scuba tank therein.

5. A plurality of inserts as in claim 4, said inserts being secured in sequence to rails arranged front-to-back in said dinghy, each of said inserts comprising a base section extending laterally across the floor of said dinghy and over said inflated side tubes.

6. A plurality of inserts as in claim 5 wherein each of said base sections includes a hole and a tubular support extending through the hole, each of said support having a diameter and a vertical dimension to secure a scuba tank therein.

* * * * *